US006323886B1

(12) United States Patent
Watanabe

(10) Patent No.: US 6,323,886 B1
(45) Date of Patent: Nov. 27, 2001

(54) IMAGE DISPLAY DEVICE

(75) Inventor: Yoshinori Watanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/228,955

(22) Filed: Jan. 12, 1999

(30) Foreign Application Priority Data

Jan. 12, 1998 (JP) ..... 10-003838

(51) Int. Cl.[7] ..... G09G 5/32; G09G 5/08
(52) U.S. Cl. ..... 345/856; 345/678; 345/157
(58) Field of Search ..... 345/145, 10, 156, 345/856, 678, 157

(56) References Cited

U.S. PATENT DOCUMENTS 5,852,431 * 12/1998 Ito ..... 345/145
5,877,745 * 3/1999 Beeteson et al. ..... 345/156
6,078,301 * 6/2000 Arai et al. ..... 345/10

FOREIGN PATENT DOCUMENTS

29714931U1 * 10/1997 (DE) ..... G06F/3/33
1-321475 12/1989 (JP) .
5-232918 9/1993 (JP) .

* cited by examiner

*Primary Examiner*—Steven Saras
*Assistant Examiner*—William C. Spencer
(74) *Attorney, Agent, or Firm*—Foley & Lardner

(57) ABSTRACT

A mouse 4-1 is connected to a display device 1 to produce, as position information, the information indicative of the amount and the direction of displacement of an image. The display device comprises an information analyzing unit for analyzing the output information from the mouse for the amount and the direction of displacement, and a setting unit for producing and setting information indicative of a new video display position in accordance with reference information and the amount and the direction of displacement analyzed by the information analyzing unit. The reference information is information stored in the display device as a current video display position.

6 Claims, 8 Drawing Sheets

IMAGE DISPLAY DEVICE

BACKGROUND OF THE INVENTION

The present invention relates to an image display system composed of an input device such as a keyboard or a mouse, a computer, and a display device. More specifically, the present invention relates to an image display system that is capable of adjusting position of an image in the horizontal and vertical directions.

Display devices used as a terminal for a computer vary in screen size and deflection frequency of a video signal to be displayed. With this respect, such display devices have been used that support various types of video signals. Some of these display devices provide optimum screen images for individual video signals by means of using a microcomputer and/or a memory LSI.

A first prior art is disclosed in Japanese Patent Laid-open No. 1-321475. An image display system according to the first prior art comprises a memory that stores image display position information and display size information for each image signal. The memory is controlled by, for example, a microcomputer. More specifically, the microcomputer reads out of the memory the image display position information and the display size information, as read-out information, that are optimum for an incoming video signal and controls a component or components such as a deflection circuit for the display device in accordance with the read-out information.

On the other hand, the incoming video signal to the display device may have an unknown type. The memory stores no information about such an unknown video signal. Under such circumstances, adjustment buttons on, for example, a front surface of the display device are used to input information for adjusting the image display position and the screen size. The microcomputer produces control information for deflection and others based on the adjustment information supplied and performs adjustment.

A second prior art is disclosed in Japanese Patent Laid-open No. 5-232918. The second prior art produces a control signal for a display device with the control signal being superposed on a video signal or a synchronization signal. The display device comprises a control signal extraction circuit and a control circuit. The extraction circuit extracts the control signal superposed on the video signal or the synchronization signal. The control circuit adjusts a video circuit or a deflection circuit in accordance with an extracted control signal.

Various methods including the above-mentioned first and second prior arts have been known for adjusting a typical display device and examples include methods for displaying an on-screen adjustment menu on the screen and methods for displaying an adjustment menu as an application program on an operation system. These adjustment menu requires an operator to depress a certain button or buttons on the front surface of the display device or to click a certain icon designated by the application program with a mouse pointer for the adjustment.

In the first prior art, controls of the image display position and the screen size are all managed by the display device itself. An operator should leave his or her hand from the input device such as a keyboard or a mouse connected to the computer and touch the adjustment button on the display device for adjustment, if required. This is often an onerous operation.

The second prior art allows operation of the display device with the input device such as a keyboard connected to the computer. However, such control with the keyboard requires combination of alphanumeric character keys to enter a command. Therefore, commanding operation with the keyboard is somewhat onerous and takes a relatively long time for proper control of the display device.

Display devices that support display of a typical adjustment menu permit only the adjustment in a single direction at a time such as in the horizontal or the vertical direction. The adjustment in one direction follows the additional adjustment in the other direction, which takes a relatively long time.

Furthermore, a control circuit for image adjustment should be provided in the computer for the adjustment of the image display system with the input device such as a keyboard or a mouse. Such a circuit complicates the configuration of the entire system.

SUMMARY OF THE INVENTION

Therefore, an object of the present invention is to provide an image display system in which various conditions including an image display position and a screen size for a display device may be adjusted directly with an input device such as a keyboard or a mouse.

It is another object of the present invention to provide an image display system of which display screen may be adjusted with an input device such as a keyboard or a mouse, without touching a display device.

It is yet another object of the present invention to provide an image display system that may be combined with a mouse button for easy choice of an adjustment item and control of, for example, contrast and brightness.

An image display system according to the present invention comprises an input device for producing information containing position information; a display device for displaying an image; and an output device for supplying a video signal to the display device.

According to a first aspect of the present invention, the input device is connected to the display device and produces, as the position information, the information indicative of the amount and the direction of displacement of an image. The display device comprises an information analyzing unit for analyzing output information produced by the input device for the amount and the direction of displacement, and a setting unit for producing and setting information indicative of a new video display position in accordance with reference information and the amount and the direction of displacement analyzed by the information analyzing unit, the reference information being information stored in the display device as a current video display position.

According to a second aspect of the present invention, the input device comprises a switch device for use in connecting the input device to either one of the output device and the display device. The input device produces, as the position information, the information indicative of the amount and the direction of displacement of an image. The display device comprises an information analyzing unit for analyzing output information produced by the input device for the amount and the direction of displacement, and a setting unit for producing and setting information indicative of a new video display position in accordance with reference information and the amount and the direction of displacement analyzed by the information analyzing unit, the reference information being information stored in the display device as a current video display position.

According to a third aspect of the present invention, the image display system comprises a plurality of input devices.

The input devices are each connected to the display device. The display device is connected with the output device via a connecting cord to transmit output information produced by the input devices. Each input device has a function to select and produce either one of an identification ID for the output device and an identification ID for the display device in order to designate a destination of the output information, and a function to add a selected identification ID to the output information. The display device comprises an information analyzing unit for determining, in response to the output information from the input devices, the destination of the output information by means of looking up the identification ID supplied by the input devices, and a plurality of output units for use in supplying, to the output device, the output information from which the identification ID is removed when the output device is determined as the destination of the output information. The information analyzing unit has a function to analyze the output information for the amount and the direction of displacement when the display device is determined as the destination of the output information. The display device further has a setting unit for producing and setting information indicative of a new video display position in accordance with reference information and the amount and the direction of displacement analyzed by the information analyzing unit, the reference information being information stored in the display device as a current video display position.

In the present invention, the input device such as a mouse for dealing with the position information may be connected directly to the display device. The display device receives the output information from the input device and analyzes the amount and the direction of displacement of an image based on received output information. The display device then reflects the result of analysis to, as the reference information, the position information in the information stored in the display device that is currently set, thereby to create adjustment data for setting the display position of the image in accordance with created adjustment data for adjusting the display device.

DESCRIPTION OF THE PREFERRED EMBODIMENT

Figure 1:
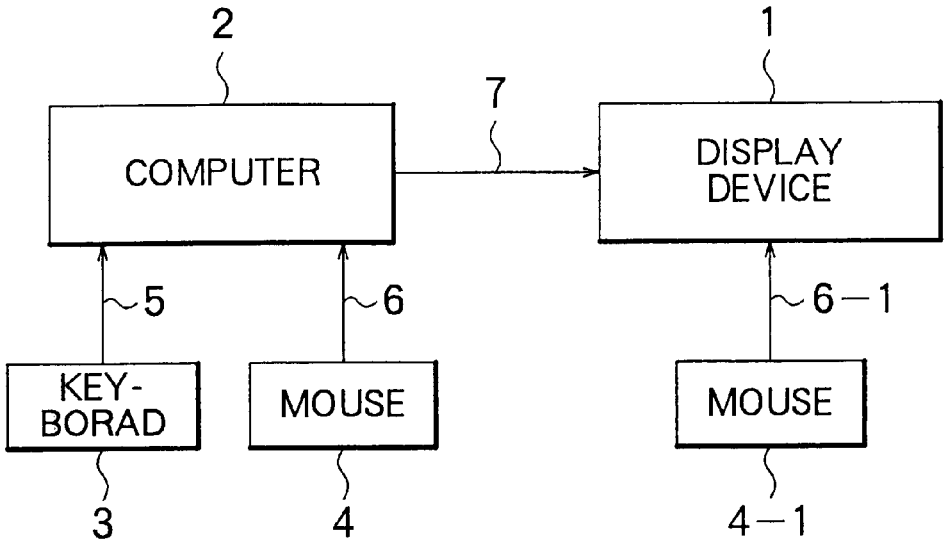
FIG. 1 is a block diagram showing configuration of an image display system according to a first embodiment of the present invention.

Referring to FIG. 1, an image display system according to a first embodiment of the present invention is described in detail. In FIG. 1, the image display system comprises a display device 1 having an on-screen function, a computer 2 that serves as a device for producing a video signal, a keyboard 3 connected to the computer 2, a mouse (input device) 4 connected to the computer 2, which serves as a pointing device for producing position information, and a mouse (input device) 4-1 connected to the display device 1. The keyboard 3 is connected to the computer 2 via a connecting cord 5. The mouse 4 is connected to the computer 2 via a connecting cord 6. The mouse 4-1 is connected to the display device 1 via a connecting cord 6-1. The computer 2 and the display device 1 are connected with each other via a connecting cord 7 for video signals.

The mouse 4 and the mouse 4-1 can be connected to both computer 2 and the display device 1 and can enter the same input. Thus, the mouse 4 may be disconnected from the computer 2, if necessary, and connected to the display device 1. In such a case, the system requires only one mouse.

Figure 2:
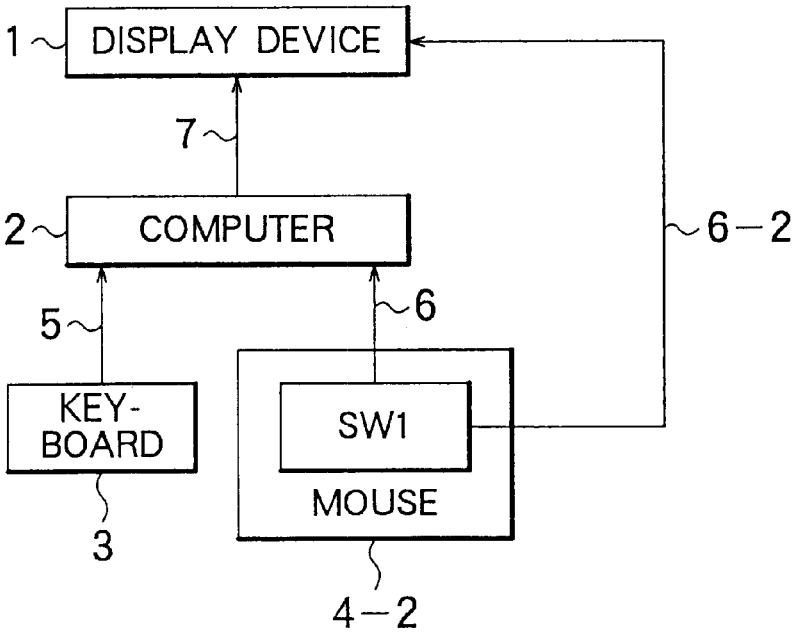
FIG. 2 is a block diagram showing a modification of the first embodiment.

Referring to FIG. 2, a modification of the embodiment in FIG. 1 is described. In this example, a mouse 4-2 is used that has a switch device (switch) SW1 capable of switching outputs to the display device 1 and those to the computer 2. The mouse 4-2 is connected to the display device 1 via a connecting cord 6-2 and is connected to the computer 2 via the connecting cord 6.

Figure 3:
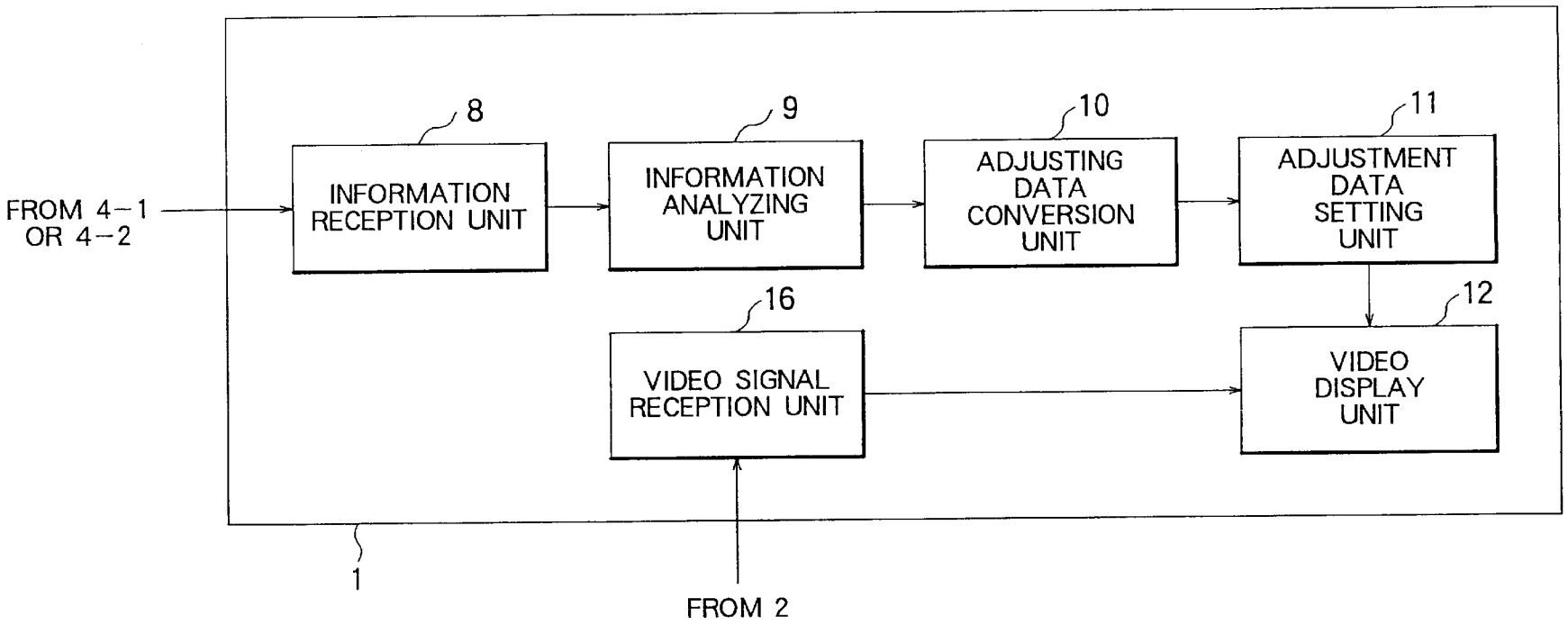
FIG. 3 is a block diagram showing configuration of the display device illustrated in FIGS. 1 and 2.

Referring to FIG. 3, configuration of the display device 1 is described. The display device 1 comprises an information reception unit 8 for receiving information supplied from the mouse 4-1 (or 4-2). The display device 1 further comprises an information analyzing unit 9, an adjusting data conversion unit 10, and an adjustment data setting unit 11. The information analyzing unit 9 analyzes the information obtained by the information reception unit 8. The adjusting data conversion unit 10 converts the information analyzed by the information analyzing unit 9 into adjusting data for the display device 1. The adjustment data setting unit 11 is for setting the data converted by the adjusting data conversion unit 10. The display device 1 further comprises a video display unit 12 for displaying video and a video signal reception unit 16 for receiving a video signal from the computer 2.

A control command supplied from the mouse 4-1 to the display device 1 contains information indicative of the amount of displacement (change amount) of the image display in horizontal and vertical directions and operational information for mouse buttons. The information reception unit 8 receives the control command from the mouse 4-1 and transforms a received control command to the information analyzing unit 9. The information analyzing unit 9 analyzes whether the received control command is for selecting a menu item for screen adjustment or for a change amount corresponding to the menu item for the current screen adjustment. The result of analysis is converted by the adjusting data conversion unit 10 into data for use in adjusting the display device 1. The adjustment data setting unit 11 sets the data converted by the adjusting data conversion unit 10. The video display unit 12 displays the video from the video signal reception unit 16 in accordance with the information set by the adjustment data setting unit 11.

Figure 4:
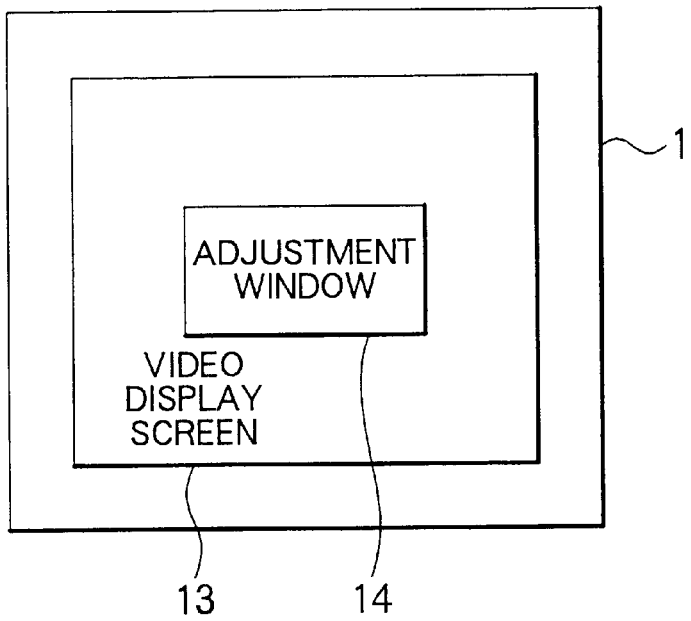
FIG. 4 is a view for use in describing the relation between a video display screen and an adjustment window on the display device.
Figure 5:
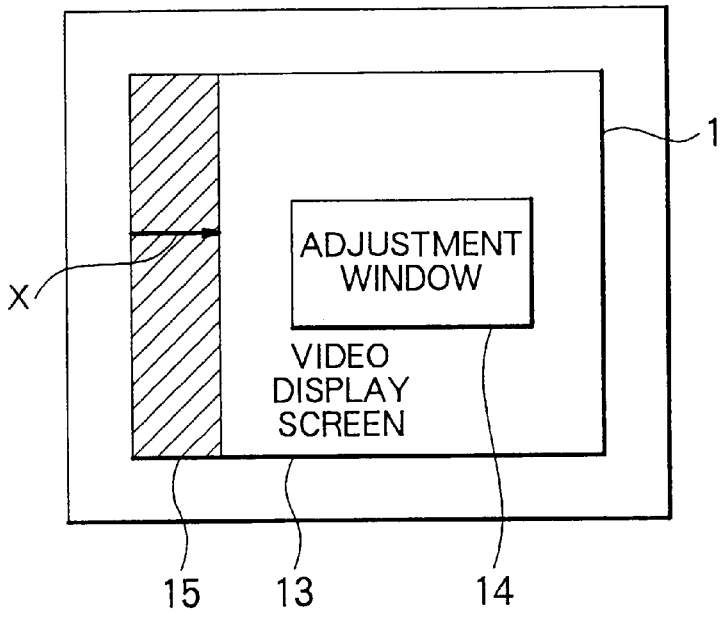
FIG. 5 is a view for use in describing horizontal displacement in adjustment of the image display position.
Figure 6:
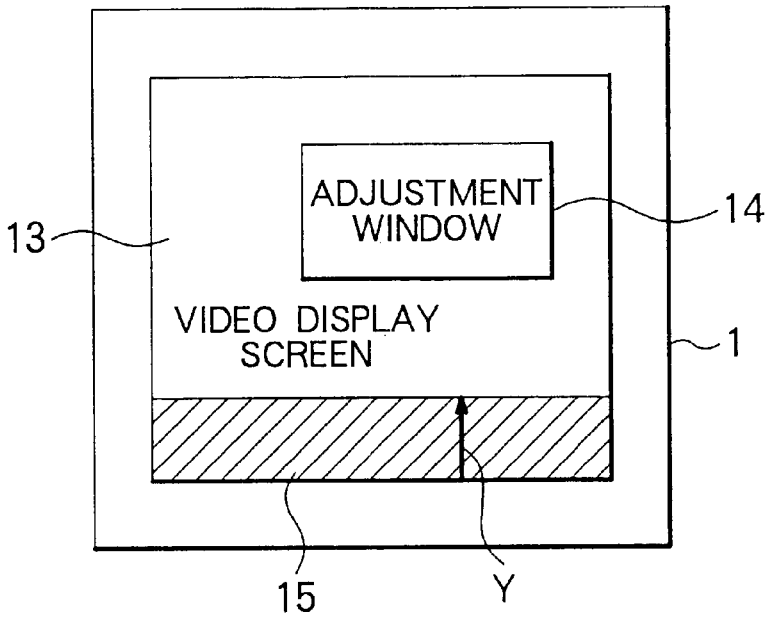
FIG. 6 is a view for use in describing vertical displacement in adjustment of the image display position.
Figure 7:
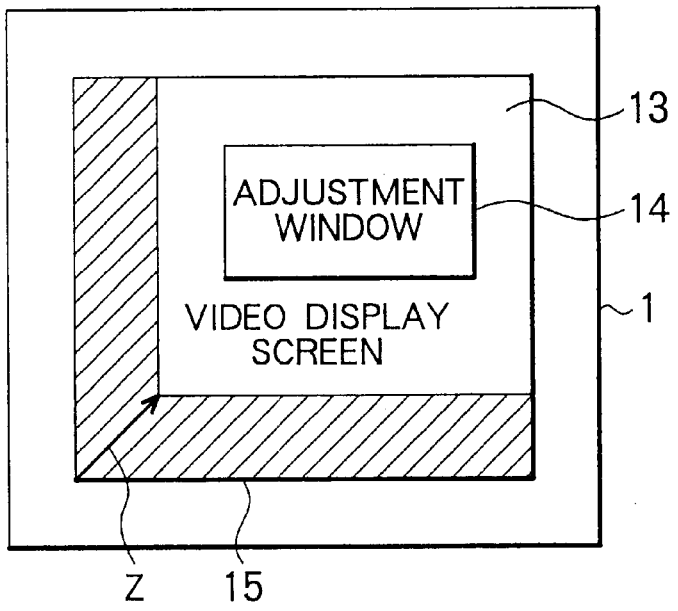
FIG. 7 is a view illustrating simultaneous displacement in both horizontal and vertical directions in adjustment of the image display position.

FIGS. 4 through 7 are views each illustrating a display mode on the display device 1. FIG. 4 shows the relation between the video display screen 13 and the adjustment window 14. FIGS. 5 and 6 shows the positional relations for the adjustment of the video display position. In FIG. 5, X depicts the amount of displacement in the horizontal direction. In FIG. 6, Y depicts the amount of displacement in the vertical direction. FIG. 7 shows an example wherein the amount of the horizontal displacement X in FIG. 5 can be adjusted simultaneously with the amount of the vertical displacement Y in FIG. 6. In FIG. 7, Z depicts a combined value of the amounts of displacement X and Y. It is noted that in FIGS. 5 through 7 the reference numeral 15 depicts a region where no video display is performed.

The control illustrated in FIG. 7 is carried out as follows. When the output of the mouse 4-1 is supplied to the display device 1, the display device 1 directly receives the information indicative of the amount of displacement Z and the direction of displacement by the mouse 4-1. The display device 1 determines how much the display position should be displacement from the current position, by using, as the reference information, the position information set as the current display position information, and the information indicative of the amount of displacement Z and the direction of displacement obtained by the mouse 4-1. The display device 1 set the determined data, which provides displacement of the video screen to any position by means of operating the mouse 4-1 rather than adjusting the display position in a single direction.

The display device 1 may recognize the state of depression of the mouse button of the mouse 4-1. To this end, the display device 1 is so designed that it may deal with items such as contrast and brightness by means of increasing or decreasing the set data. More specifically, the display device 1 may change in display contrast or brightness by means of recognizing the state of depression of the mouse button of the mouse 4-1. For the selection of other adjustment menu items, selection may be made based on combination of the mouse buttons of the mouse 4-1.

Figure 8:
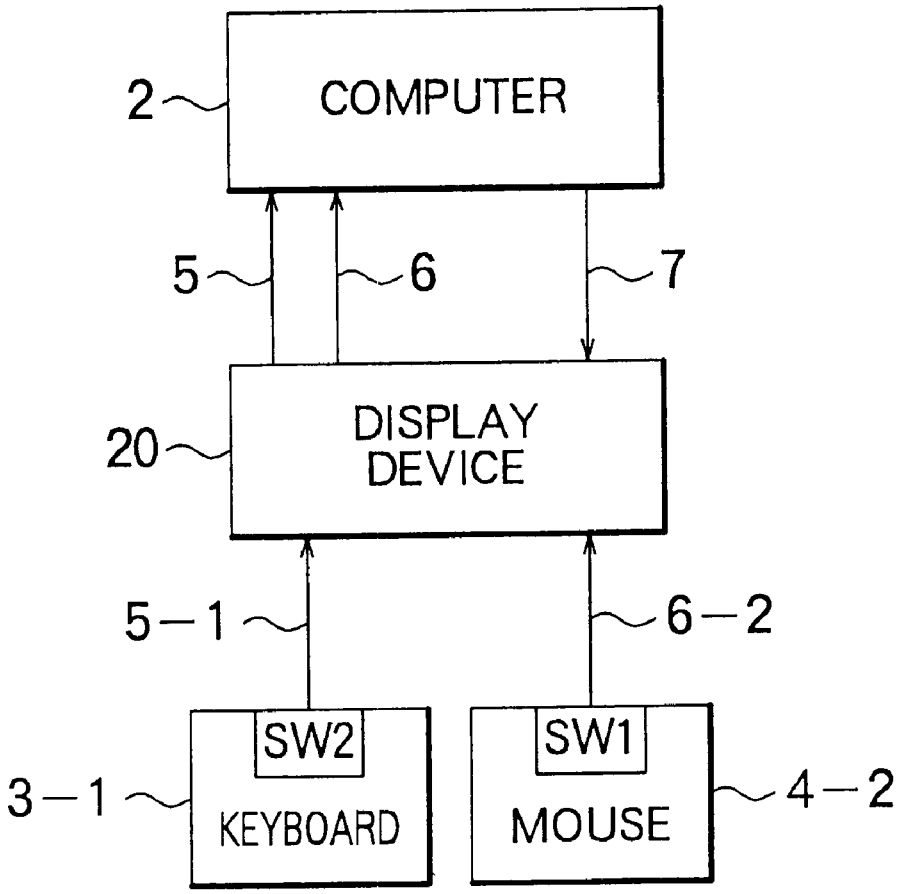
FIG. 8 is a block diagram showing configuration of an image display system according to a second embodiment of the present invention.

Referring to FIG. 8, an image display system according to a second embodiment of the present invention is described. In FIG. 8, similar components and parts to those in FIG. 1 are depicted by the same reference numerals and description of such components and parts are omitted. This embodiment comprises a keyboard 3-1 having a switch device SW2 and a mouse 4-2 having the switch device SW1 described in conjunction with FIG. 2. As will be described below, a display device 20 has different configuration from the display device 1 described in FIG. 1. The keyboard 3-1 is connected to the display device 20 via a connecting cord 5-1 while the mouse 4-2 is connected to the display device 20 via a connecting cord 6-2. The display device 20 is connected to the computer 2 via the connecting cords 5, 6, and a connecting cord 7 for video signals.

The data produced by the keyboard 3-1 and the mouse 4-2 are classified into two groups, that is, the data to be supplied to the computer 2 and the data to be supplied to the display device 20. This becomes possible in the following manner. The keyboard 3-1 and the mouse 4-2 have a function to add an identification ID that designates destination before transmitting normal output data. The keyboard 3-1 and the mouse 4-2 can switch, by means of the switch devices SW2 and SW1, the identification ID for use in designating the computer 2 and the identification ID for use in designating the display device 20. In the following description, the identification ID for use in designating the computer 2 by the keyboard 3-1 is referred to as a keyboard ID while the identification ID for use in designating the computer 2 by the mouse 4-2 is referred to as a mouse ID. The identification ID for use in designating the display device 20 is referred to as an adjustment ID.

Figure 9:
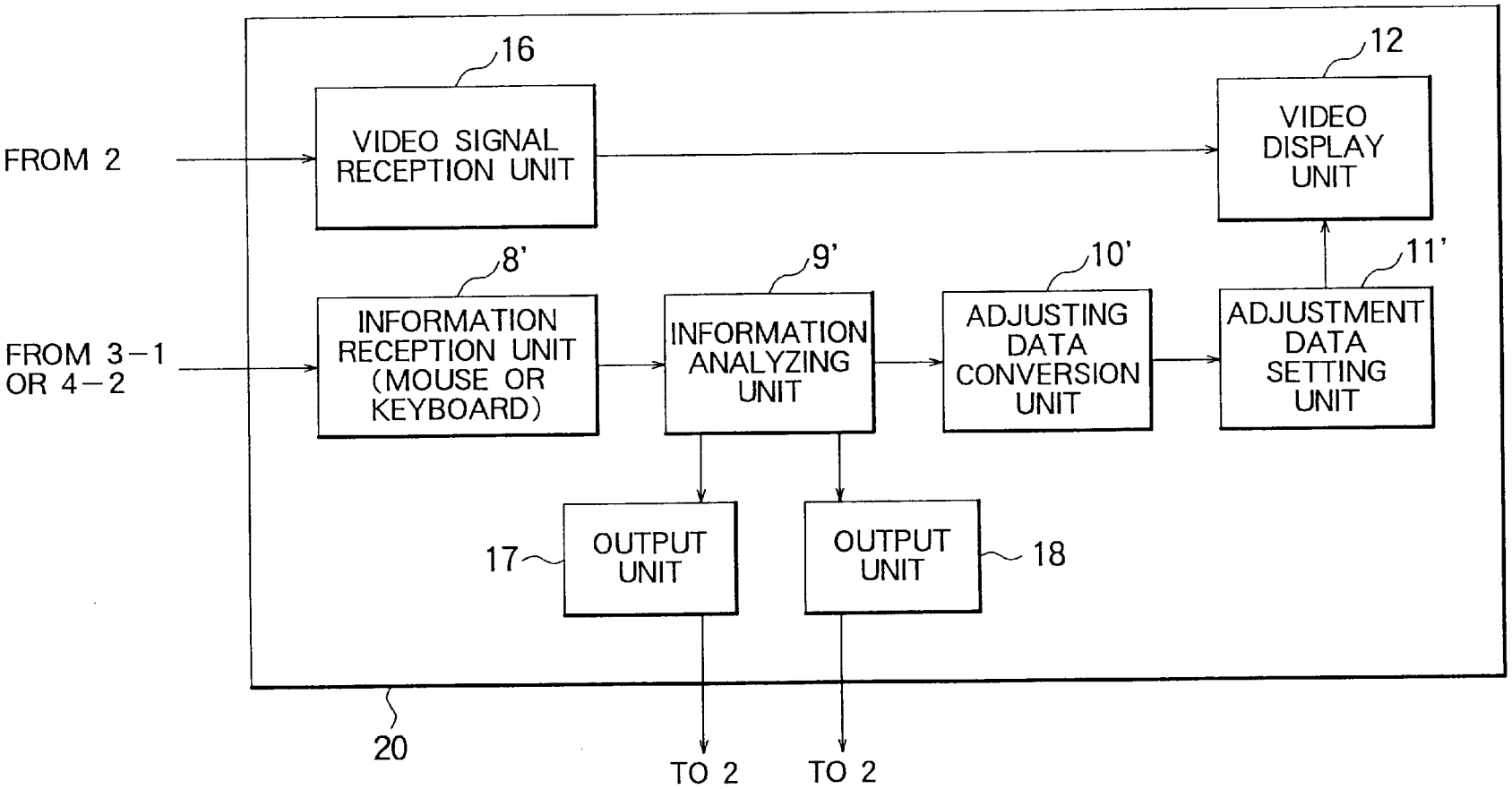
FIG. 9 is a block diagram showing configuration of the display device in FIG. 8.

Referring to FIG. 9, the display device 20 comprises an output unit 17 for the keyboard and an output unit 18 for the mouse, together with an information reception unit 8', an information analyzing unit 91, an adjusting data conversion unit 10', an adjustment data setting unit 11', a video display unit 12', and a video signal reception unit 16. The information reception unit 8' receives the information supplied from the keyboard 3-1 and the mouse 4-2. The information analyzing unit 9' analyzes received information received by the information reception unit 8' (command analysis). More specifically, as will be described below, the information analyzing unit 9' makes an analysis to determine whether the received information is a command for a keyboard, a command for a mouse, or an existing command. The information analyzing unit 9' also makes an analysis to determine whether the received information is the information for the computer 2 or the information for the display device 20.

The adjusting data conversion unit 10' converts the received information into data for use in adjusting the display device 20 when the information analyzing unit 9' determines, as a result of the analysis, that the received information is the information for the display device 20. The adjustment data setting unit 11' is for setting the data converted by the adjusting data conversion unit 10'. The output unit 17 supplies the information from the keyboard 3-1 to the computer 2 when the received information is analyzed as the information from the keyboard 3-1. The output unit 18 supplies the information from the mouse 4-2 to the computer 2 when the received information is analyzed as the information from the mouse 4-2.

Figure 10:
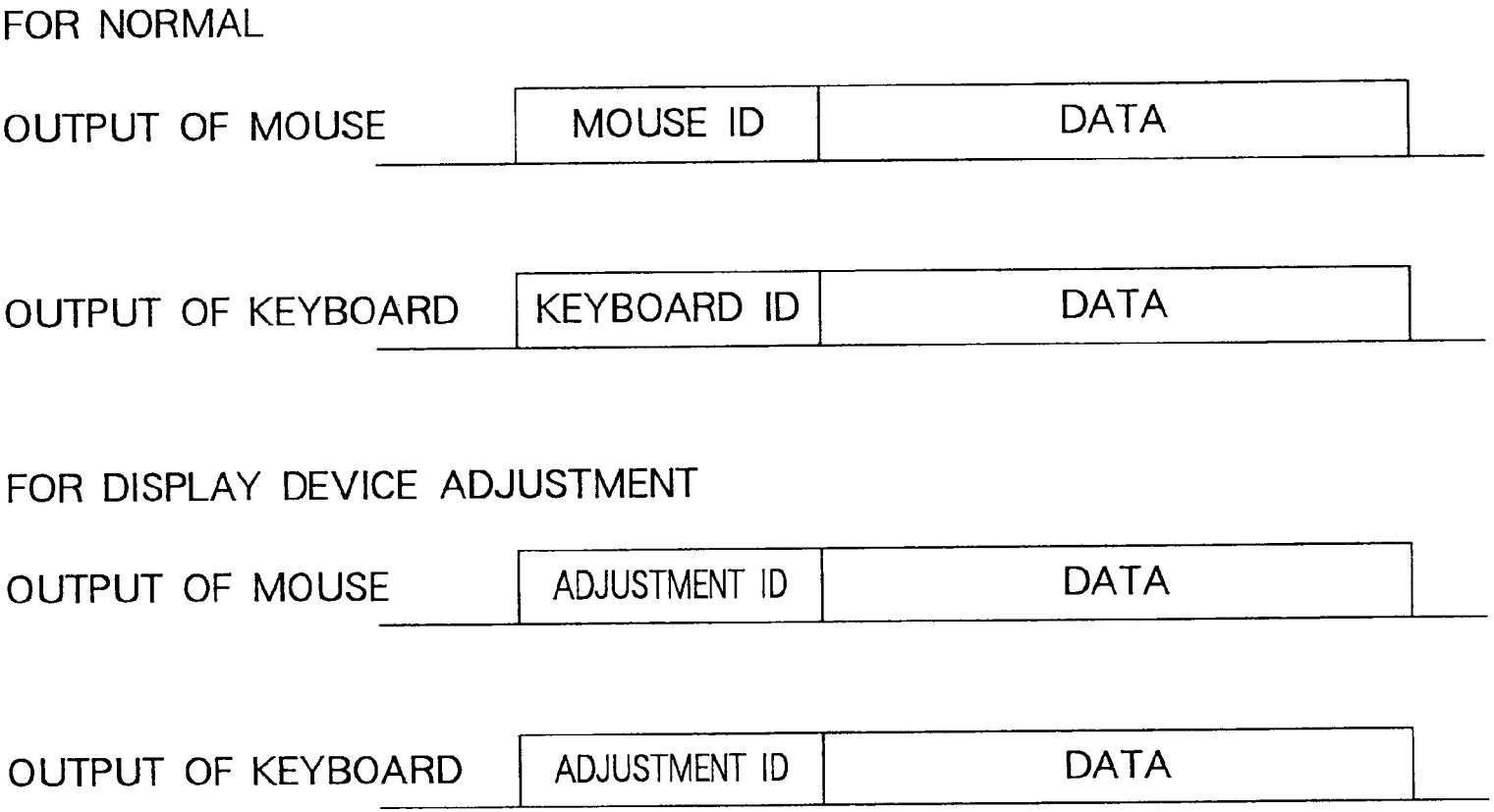
FIG. 10 is a view illustrating output data from a mouse and a keyboard in the image display system according to the present invention.

Referring additionally to FIG. 10, operation of the second embodiment is described. FIG. 10 shows a format of output data from the keyboard 3-1 and the mouse 4-2. The data illustrated are for normal display and for adjustment of the display device. For the normal display, the keyboard 3-1 and the mouse 4-2 produce the output data with the keyboard ID and the mouse ID, respectively, added ahead of the output data.

On the other hand, for the adjustment of the display device, the keyboard 3-1 and the mouse 4-2 produce the output data with the adjustment ID added ahead of the output data. The keyboard 3-1 and the mouse 4-2 can switch these two IDs by means of the switch devices SW2 and SW1.

In response to the reception of the above-mentioned output data, the display device 20 performs reception, analysis, output, conversion of the adjusting data and setting.

Figure 11:
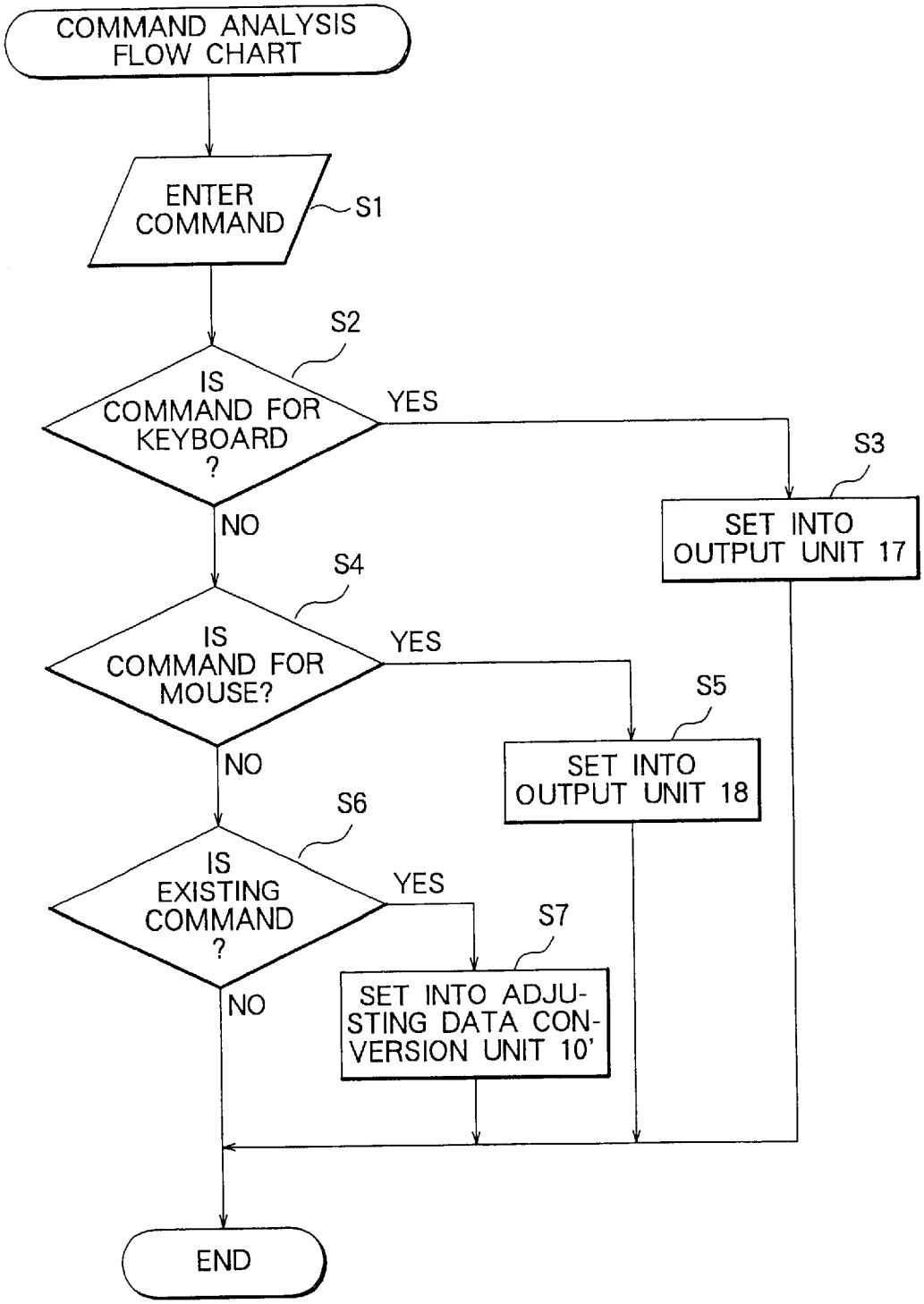
FIG. 11 is a flow chart for use in describing operation of an input image analyzing unit illustrated in FIG. 9.

Referring additionally to FIG. 11, to analyze the commands from the keyboard 3-1 and the mouse 4-2 is described. At a step S1, a command is supplied from the keyboard 3-1 or the mouse 4-2. A step S2 refers the keyboard ID to determine whether the supplied command is a command for the keyboard. If it is the keyboard ID, then a step S3 sets into the output unit 17 data obtained by means of removing the keyboard ID from the output data for the keyboard.

On the other hand, if it is not the keyboard ID, then the mouse ID is referred to determine whether it is a command for the mouse (Step S4). If it is the mouse ID, then a step S5 sets into the output unit 18 data obtained by means of removing the mouse ID from the output data for the mouse. If it is not the mouse ID, then the process goes through command determination for image adjustment (step S6).

In the command determination for the image adjustment, the adjustment ID is referred to determine whether the command is an existing command for use in adjusting the display device. If it is the existing command, then the command is set into the adjusting data conversion unit 10' (Step S7). On the other hand, if it is not the existing command, then nothing is performed but to terminate the operation.

The flow chart in FIG. 11 is the operation carried out by the information analyzing unit 9' in the display device 20. The overall procedure is as follows. The outputs of the keyboard 3-1 and the mouse 4-2 are directly supplied to the display device 20. Thus, the display device 20 can analyze the input devices (a mouse, a keyboard) and the control is made directly based on the information that is associated with the display device 20 and that is supplied from the input devices.

From the display device 20 to the computer 2, the data from which the IDs for the keyboard 3-1 and the mouse 4-2 (the mouse ID and the keyboard ID) are removed are supplied through the connecting cords 5 and 6, respectively. Thus, no special circuit is required to be added to the computer 2.

As described above, the image display system according to the present invention permits adjustment of the display device only by means of the operation with the mouse because the information from the input device such as the mouse is directly supplied to the display device. Therefore, an operator of the computer can adjust the image display with the input device such as the keyboard or the mouse, without touching the adjustment button(s) on the display device which otherwise is made conventionally.

In addition, the input device itself such as the keyboard and the mouse is connected to the display device. This allows the display device to determine for what the information from the keyboard or the mouse is supplied. Accordingly, the display device can be adjusted by means of the operation with the input device.

Furthermore, the input device can be connected to the display device rather than the computer, which eliminates a problem associated with the lack of length of a cord.

The position and the placement of the video screen may be adjusted according to a slight, fine movement of the mouse. Therefore, horizontal and vertical operations which have been dealt with separately for adjusting the display device can be done simultaneously as a single operation.

Moreover, the operation with the input device such as the mouse eliminates the necessity of depressing a certain button on the front surface of the display device or clicking an icon designated by an application program with a mouse pointer, as is made conventionally. For the movement in a certain direction of horizontal or vertical, the adjustment is made simultaneously in both horizontal and vertical directions.

The display device can obtain the information about the mouse button of the mouse. Therefore, other types of adjustment than the adjustment of the display position can be made with the mouse by means of combining the mouse button with, for example, selection of the adjustment items or control of the contrast.

Furthermore, it is not necessary for the computer to have a control circuit to control the display device, eliminating complicated configuration and structure while reducing the costs.

What is claimed is:

1. An image display system comprising:

a plurality of input devices for producing information containing position information;

a display device for displaying an image; and an output device for supplying a video signal to said display device, wherein said input devices are each connected to said display device, said display device being connected with said output device via a connecting cord to transmit output information produced by said input devices, each of said input devices having a function to select and produce either one of an identification ID for said output device and an identification ID for said display device in order to designate a destination of said output information, and a function to add selected identification ID to said output information, said display device comprising:

information analyzing means for determining, in response to said output information from said input devices, the destination of said output information by means of said identification ID supplied by said input devices; and a plurality of output means for use in supplying, to said output device, said output information from which said identification ID is removed when said output device is determined as the destination of said output information, said information analyzing means having a function to analyze said output information for the amount and the direction of displacement when said display device is determined as the destination of said output information, said display device further having setting means for producing and setting information indicative of a new video display position in accordance with reference information and the amount and the direction of displacement analyzed by said information analyzing means, said reference information being information stored in said display device as a current video display position.

2. An image display system as claimed in claim 1, wherein said setting means comprising:

data conversion means for converting the amount and the direction of displacement analyzed by said information analyzing means into data for use in adjusting said display device; and data setting means for setting data converted by said data conversion means.

3. An image display system as claimed in claim 1, wherein said output device is a computer, and said plurality of input devices are each a mouse or a keyboard.

4. An image display system comprising:

a plurality of input devices for producing information containing position information;

a display device for displaying an image; and an output device for supplying a video signal to said display device, wherein said input devices are each connected to said display device, said display device being connected with said output device via a connecting cord to transmit output information produced by said input devices, each of said input devices having a function to select and produce either one of an identification ID for said output device and an identification ID for said display device in order to designate a destination of said output information, and a function to add selected identification ID to said output information, said display device comprising:

an information analyzing device for determining, in response to said output information from said input devices, the destination of said output information by a device of said identification ID supplied by said input devices; and a plurality of output devices for use in supplying, to said output device, said output information from which said identification ID is removed when said output device is determined as the destination of said output information, said information analyzing device having a function to analyze said output information for the amount and the direction of displacement when said display device is determined as the destination of said output information, said display device further having a setting device for producing and setting information indicative of a new video display position in accordance with reference information and the amount and the direction of displacement analyzed by said information analyzing device, said reference information being information stored in said display device as a current video display position.

5. An image display system as claimed in claim 4, wherein said setting device comprising:

a data conversion device for converting the amount and the direction of displacement analyzed by said information analyzing device into data for use in adjusting said display device; and a data setting device for setting data converted by said data conversion device.

6. An image display system as claimed in claim 4, wherein said output device is a computer, and said plurality of input devices are each a mouse or a keyboard.

* * * * *